United States Patent [19]

Tierney

[11] 4,073,522

[45] Feb. 14, 1978

[54] SECURITY STEP OR STOP FOR SLIDABLE DOOR

[75] Inventor: Timothy P. Tierney, Hazlet, N.J.

[73] Assignee: The Raymond Lee Organization, Inc., New York, N.Y.

[21] Appl. No.: 740,171

[22] Filed: Nov. 9, 1976

[51] Int. Cl.[2] ..... E05C 17/08

[52] U.S. Cl. ..... 292/262; 292/288

[58] Field of Search ..... 292/259, 262, 288, 338, 292/339, DIG. 31, DIG. 46, DIG. 49, DIG. 72

[56] References Cited

U.S. PATENT DOCUMENTS

| | | | |
|---|---|---|---|
| 136,431 | 3/1873 | Gates | 292/288 X |
| 1,392,467 | 10/1921 | Topp | 292/339 |
| 2,647,782 | 8/1953 | Fish | 292/339 X |
| 3,698,754 | 10/1972 | Means | 292/262 |
| 3,820,285 | 6/1974 | Shiffler et al. | 292/262 X |
| 3,825,290 | 7/1974 | Messina et al. | 292/262 |

*Primary Examiner*—Richard E. Moore
*Attorney, Agent, or Firm*—Howard I. Podell

[57] ABSTRACT

A hinged unit that serves as a security door step to prevent opening of a slidable door. The unit consists of a pair of bars pivotably linked together at adjoining ends and of a length to fit in the extended position, between an external bottom side edge of a slidable door and the bottom side edge of the door frame within the bottom channel in which the door slides to block movement of the door in the closed door position. The hinge line is located below the horizontal longitudinal axis of the joined bars in the extended position. A pivoted kicker plate is pivoted to one bar so that downward pressure on the kicker plate serves to raise the hinge point above the horizontal axis so that the bars will fold upward about the hinge point to permit the bars to fold against the door frame along a vertical axis as the door is opened.

1 Claim, 4 Drawing Figures

SECURITY STEP OR STOP FOR SLIDABLE DOOR

SUMMARY OF THE INVENTION

My invention is a hinged unit that serves as a security door stop to prevent opening of a slidable door. The unit consists of a pair of bars pivotably linked together at adjoining ends and of a length to fit in the extended position, between an external bottom side edge of a slidable door and the bottom side edge of the door frame within the bottom channel in which the door slides to block movement of the door in the closed door position. The hinge line is located below the horizontal longitudinal axis of the joined bars in the extended position. A pivoted kicker plate is pivoted to one bar so that downward pressure on the kicker plate serves to raise the hinge point above the horizontal axis so that the bars will fold upward about the hinge point to permit the bars to fold against the door frame along a vertical axis as the door is opened.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
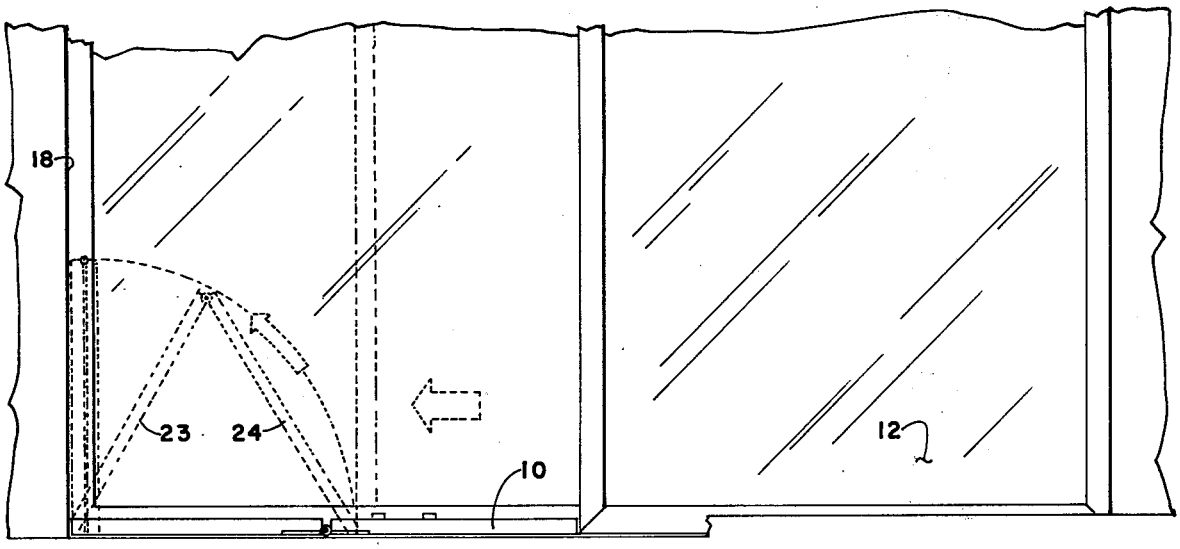
FIG. 1 is a side view of the invention, in use.
Figure 2:
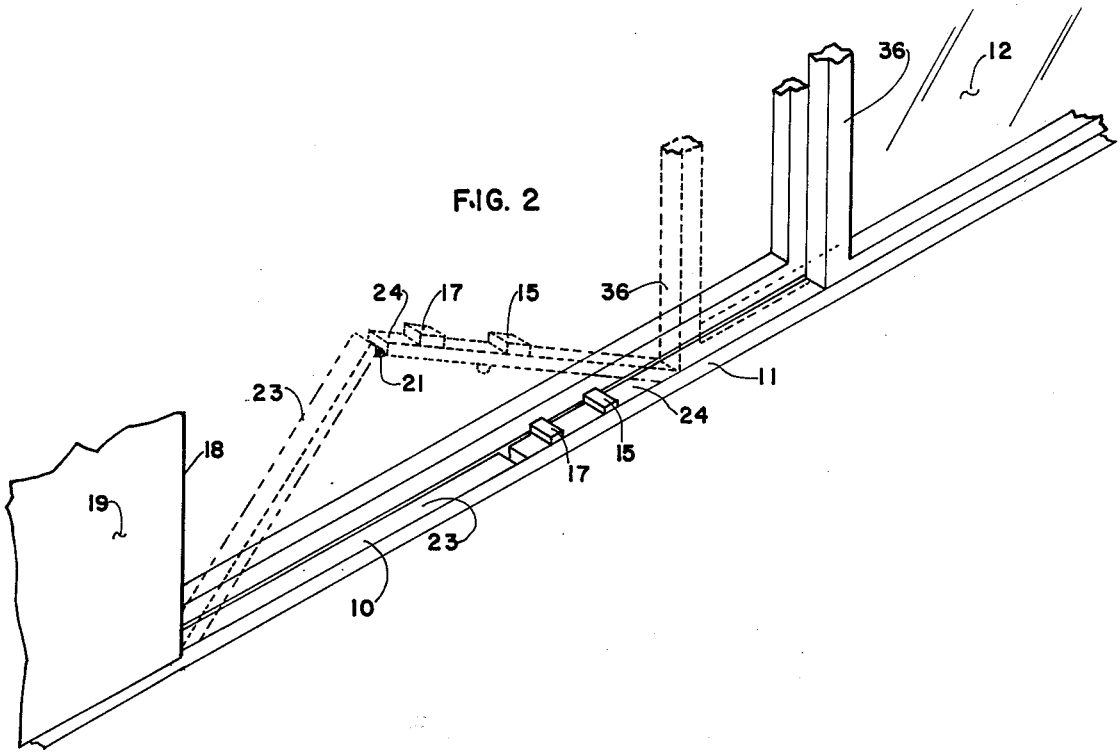
FIG. 2 is a perspective view of the invention.
Figure 3:
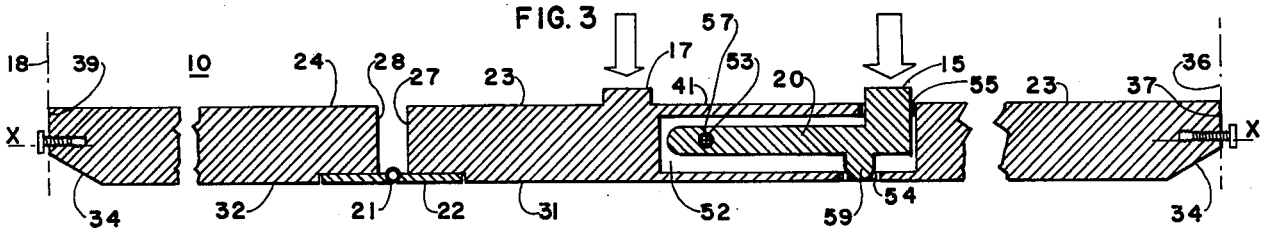
FIG. 3 is a sectional view of the invention.

Turning now descriptively to the drawings, in which similar reference characters denote similar elements throughout the several views, FIGS. 1-3 illustrate the security stop assembly 10 which may be installed freely in the bottom open channel 11 in which a slidable door 12 tracks, to prevent opening a sliding of the door 12 except when the projection knob 15 of a pivoted kicker plate 20 is depressed by a user's foot to rotate the pivot pin 21 of a hinge joining the two bars 23 and 24 upward and above the horizontal axis X—X of the extended assembly so that bars 23 and 24 may rotate, as shown in dotted lines in FIGS. 1-2 to a vertical folded position as the door 12 is slid towards the fixed vertical end frame member 18 of the fixed door frame 19.

Assembly 10 consists of two bars 23, 24 joined together at adjacent ends 27, 28 respectively by a hinge flush mounted to the bottom surfaces 31, 32 respectively of the bars 23, 24, with the hinge pin 21 lying closely adjacent the plane of the said bottom surfaces 31, 32 and at a distance from the horizontal axis X—X of the extended bars, as shown in FIG. 3. The bottom opposed end corner 34 of each bar 23, 24 is relieved so that an endwise bearing load applied between a door 12 and the door frame 19 against the extended bars will be taken along or above the horizontal axis X—X of the extended bars causing a bending movement about hinge pin 21 that tends to force hinge 22 downward into channel 11, with abutting end surfaces 27 and 28 preventing further rotation of the bars about the hinge pin 21, and preventing such a bearing load applied to door 12 from opening the door with the bottom external side edge 36 bearing against end surface 37 of bar 23, and the bottom external side edge 18 bearing against opposed end surface 39 of bar 24 in the closed position of the door 12.

To ensure that bars 23 and 24 are rotated with hinge pin 21 located below horizontal axis X—X, when the door 12 is closed, a projection knob 17 is fixed to bar 23, and mounted to project above the upper surface 41 of bar 23 to permit the user to depress knob 17 with his foot (not shown) so as to depress hinge pin 21 below the horizontal axis X—X.

Figure 4:
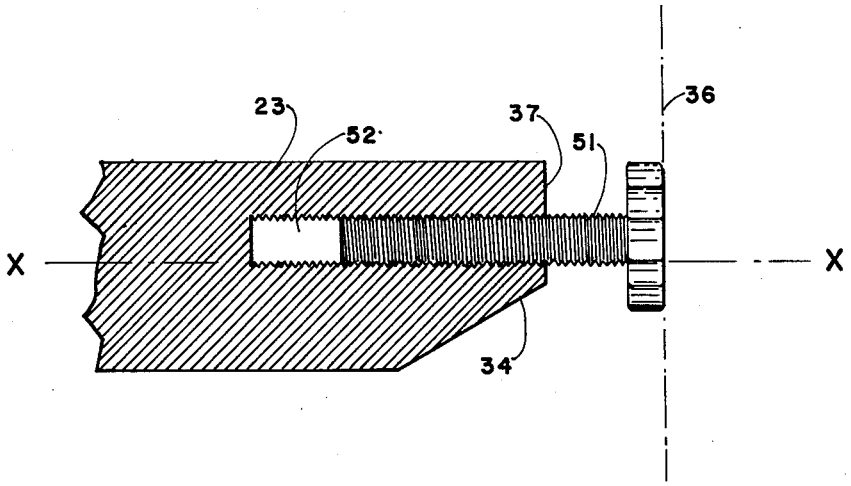
FIG. 4 is a detail sectional view of an adjustment screw.

As shown in FIG. 4, an adjustment screw 51 may be threaded into a threaded hole 52 extending along or above axis X—X from end surface 37 of a bar 23 so that the total length of the assembly 10 in the extended position may be adjusted to fit firmly between the closed door 12 and the frame 19 in the extended position of the assembly.

A kicker plate 20 as shown in FIG. 3, is pivotably mounted in a recess 52 in bar 23 by a pin 53 with pin 53 extending transversely to, and generally intersecting the axis X—X, in the extended position, and with pin 53 fixed to opposed sides of recess 52 of bar 23. An opening 54 to recess 52 is provided through bottom surface 31 of bar 23 and an opening 55 to recess 52 is provided through top surface 41 of bar 23. Kicker plate 20 is formed with an end knob 15 that projects through opening 55 and above upper surface 41 of bar 23 and with a detent 59 located between knob 15 and the hole 57 of plate 20 in which pin 33 is mounted, with detent 59 projecting through bottom opening 54 when kick plate 20 is rotated by downward vertical pressure of a user's foot against knob 15 for the purpose of "breaking" the joint by forcing plate pin 33 and hinge pin 21 above the horizontal axis X—X in the extended position. Detent 59, when forced so downward bears against the bottom wall of channel 11 and by elevating hinge pin 21 above axis X—X permits bars 23 and 24 to fold about pin 21 as bearing pressure is applied against opposed end surfaces 37 and 39 by manual horizontal force against door 12 towards frame end 18 to permit door 12 to readily open.

As door 12 is manually slid to the open position, bars 23 and 24 rotate to the folded vertical position between door 12 and frame as shown in dotted lines in FIG. 1. When the door is slid towards the closed position, the bars 23 and 24 may be manually tapped to unfold back towards the extended position.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A unit formed of a first bar hinged to a second bar that serves as a security stop for the prevention of opening of a slidable door, when placed on the track of a said slidable door with the lower surface of each bar resting on said track in an extended position of said bars, said bars joined together by hinge at a first end of each bar so that both bars may be folded in a first circular direction about the pivot axis of the hinge from a first extended position in which a longitudinal axis of each bar forms a common straight line, to a second position in which said axes form two generally parallel lines with the lower surface of each bar facing each other, with means to prevent said bars in said first extended position from rotating to said second position in response to a longitudinal force applied against the opposed end surfaces of the bars, and permanent means to prevent said bars from rotating in said first extended positon in a second circular direction about the pivot axis of the hinge that is contrary to said first circular direction, in which one of the bars is fitted with means to lengthen the distance from the hinge to the external end surface of the said bar, and in which the opposed lower end surfaces of the two bars are each recessed so that the bearing end surface of each said end surface does not intersect the longitudinal axis of the bar that passes through the pivot axis of the hinge when the bars are in the said first position, with said longitudinal axis being spaced from the central longitudinal axis of each bar towards the lower surface of each bar so that a bearing force against said bar end surfaces, in said first extended position, creates a rotational movement contrary to said first circular direction, together with pivotable means mounted to a first bar which causes the bars to rotate in said first extended position in the said first circular direction so as to cause the pivot axis of the hinge to move past the central longitudinal axis so as to unlatch hinge joint, said pivotable means in the form of a kicker plate formed with a first section located so as to contact a base surface on which the lower surface of the first bar rests, in the extended position of the bar and with a second section located so as to extend beyond the upper profile of said first bar when the said first section is in contact with the base surface of which the first bar rests, with said kicker plate pivotally mounted to said first bar along a pivotal axis with the said first section located between the said pivotal axis and the second section such that foot pressure applied against said second section towards the base surface, when the bars are in the extended position and resting on said base surface, causes the pivot axis of the hinge to move away from said base surface so that the two bars may fold together to rotate towards the second position in response to a longitudinal applied force against bearing end surfaces of the two bars.

* * * * *